United States Patent [19]

Fein

[11] 4,215,002

[45] Jul. 29, 1980

[54] WATER-BASED PHOSPHONATE LUBRICANTS

[75] Inventor: Richard S. Fein, Poughkeepsie, N.Y.

[73] Assignee: Texaco Inc., White Plains, N.Y.

[21] Appl. No.: 929,374

[22] Filed: Jul. 31, 1978

[51] Int. Cl.[2] ..... C10M 1/46

[52] U.S. Cl. ..... 252/32.5; 252/49.3; 252/49.5; 252/49.8; 252/49.9; 252/75; 252/78.5

[58] Field of Search ..... 252/32.5, 49.3, 49.5, 252/49.8, 49.9, 75, 78.5

[56] References Cited

U.S. PATENT DOCUMENTS

| | | | |
|---|---|---|---|
| 2,965,570 | 12/1960 | Fierce et al. | 252/49.8 |
| 3,033,889 | 5/1962 | Chiddix et al. | 252/49.8 UX |
| 3,346,670 | 10/1967 | Papalos | 252/49.8 X |
| 3,485,898 | 12/1969 | Peterson | 252/49.8 X |
| 3,496,104 | 2/1970 | Shimada et al. | 252/49.5 X |
| 3,532,632 | 10/1970 | Sugarman et al. | 252/49.5 X |
| 3,779,928 | 12/1973 | Schlicht | 252/75 |
| 3,793,199 | 2/1974 | Schlicht | 252/32.5 |

FOREIGN PATENT DOCUMENTS

| | | | |
|---|---|---|---|
| 1276273 | 8/1968 | Fed. Rep. of Germany | 252/32.5 |
| 52-7511 | 2/1977 | Japan | 252/49.8 |

*Primary Examiner*—Thomas A. Waltz

*Attorney, Agent, or Firm*—Carl G. Ries; Robert A. Kulason; Henry W. Archer

[57] ABSTRACT

Water-based lubricant useful for metal cutting, grinding and forming and suitable as hydraulic fluids are described as consisting essentially of 0.5 to 4 percent by weight, balance, water; of a synergistic blend of a $C_6$ to $C_{18}$ alkylphosphonate or an amine adduct thereof and an ethoxylate of an acid or an alcohol containing from 3 to 20 ethoxy groups wherein the acid or alcohol is derived from fatty or synthetic sources.

3 Claims, No Drawings

WATER-BASED PHOSPHONATE LUBRICANTS

BACKGROUND OF THE INVENTION

Field of the Invention

This invention relates to an additive package for imparting wear protection, low static and kinetic friction and extreme pressure properties to water-based lubricants and to lubricating compositions containing same.

Water-based lubricants are particularly valuable because of their fire-resistant properties. However, such lubricants are generally deficient in extreme pressure and antiwear properties which fact limits their usefulness.

The object of this invention is to provide water-based lubricants which have improved properties.

SUMMARY OF THE INVENTION

The present invention comprises an additive package comprising a blend of 99 percent to one percent by weight of a $C_6$ to $C_{18}$ alkylphosphonate, an amine adduct thereof, a mixture of such phosphonate and an amine or a mixture of the foregoing and 1 to 99 percent by weight of an ethoxylate of an acid or an alcohol containing from 3 to 20 ethoxy groups wherein the acid or alcohol is derived from fatty or synthetic sources.

In another aspect, the invention contemplates a water based lubricant containing from 0.5 percent to four percent of the above mixture in water.

Suitable alkylphosphonates include those disclosed and claimed in coassigned U.S. Pat. No. 3,793,199 which are ammonium salts of alkyl alkanephosphonates represented by the formula:

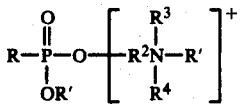

in which R is a substantially straight chain aliphatic radical having from about 11 to 40 carbon atoms, R′ is a lower aliphatic radical having from one to eight carbon atoms, $R^2$ is a hydrocarbyl radical having from 1 to 40 carbon atoms and $R^3$ and $R^4$ are hydrogen, a hydrocarbyl radical having from one to 40 carbon atoms, or a substituted hydrocarbyl radical having amino, alkylamino or hydroxyl functional groups. The additive package is prepared by mixing the constituents in a suitable blender.

The blends are then emulsified in the desired amount of water.

The invention is illustrated in non-limiting fashion by the following Examples.

EXAMPLES

A number of lubricating compositions containing various amounts of the additive package were tested for effectiveness.

In Table I, below the Four Ball Test results on an 85/15 mixture of dimethyltetradecane phosphonate and 5-ethoxy-oleyl ester illustrate the effectiveness of the additive compared to mineral oil and an invert emulsion hydraulic oil. The Load Wear Index given in Tables I and II refers to the load carrying property of a lubricating fluid. It is an index of the ability of a lubricant to prevent wear at applied loads. Under the conditions of the test, specific loadings in kilograms having intervals of 0.1 logarithm units are applied to three stationary balls for ten runs prior to welding. The test procedure is described in ASTM 02783-71. The Four Ball Wear Test which determines wear preventive characteristics in sliding steel-on-steel applications was carried out as described in ASTM D226667, modified as set forth in Tables I and II. The Anti Wear Number (AWN) was determined as described in *Lubrication Engineering*, Vol, 51, 581,2 (1975).

TABLE I

| Conc. of 85/15 Additive in $H_2O$ | Index-Wear-Index | FOUR BALL FRICTION AND WEAR* | | | |
|---|---|---|---|---|---|
| | | | | 28 kg Frict. Coeff. | |
| | | AWN a 7.5 kg | AWN a 28 kg | Kinetic | Static |
| 0.5% | 38 | 6.4 | 7.1 | 0.079 | 0.079 |
| 1.0% | 62 | 6.45 | 7.3 | — | — |
| 2.0% | 49 | 6.55 | 7.2 | 0.066 | 0.070 |
| 4.0% | 49 | 6.6 | 6.9 | 0.068 | 0.074 |
| Solvent Neutral Mixed Oil 1 | — | 6.4 | 7.4 | 0.098 | 0.17 |
| Solvent neutral Mixed Oil 2 | — | 7.0 | 7.5 | 0.098 | 0.18 |
| Invert Emulsion | 25, 31 | 7.5 | 7.8, 7.2 | — | — |

*Four Ball test conditions - ½h, 1800 rpm, 130° F.

The above data show that the compositions of the invention have better load wear indices than the invert emulsion. The data show also that the compositions of the invention have lower coefficients of friction than the base oils.

Table II illustrates the synergism between the phosphonate and ethoxylate.

Table III summarises laboratory "black plate" steel ironing test results indicating that a blend of two ingredients at low concentrations in water can give as low energy consumption and less metal pick-up on the tooling than a neat fatty oil.

The data of Table III was obtained by the SILS:III test which irons the "sidewalls" of a bent two-dimensional "cup" of blackplate steel from about 0.013 inches to about 0.0008 inches thickness. The ironing occurs when the U-shaped "cup" is pulled by a steel punch at 4 inches/minute between two carbide dies in a tensile test machine. Several "cups" are ironed in series with each lubricant. The total work to iron each cup is measured and the average work calculated; the total iron pick-up on the die and punch for the test series is also measured after selective dissolution. Ironing work and iron pick-up are expressed as ratios to values obtained with neat lard oil "good" reference lubricant series that either immediately precedes or follows the test lubricant series.

TABLE II

FOUR BALL TEST RESULTS

| | Load Wear Index | Four Ball Friction and Wear in ½hr, 1800 rpm, 130° F. Tests: AWN a 7.5 kg | AWN a 28 kg | 28 Kg Friction Coeff. Kinetic | 28 Kg Friction Coeff. Static |
|---|---|---|---|---|---|
| 100% Distilled Water | — | 6.2 | 5.9 | >0.2 | |
| Additive & Concentration in Water | | | | | |
| A. 1.0% Dimethyltetradecane-phosphonate 49, 62 | | — | 7.0, 6.7 | 0.086, 0.092 | 0.086, 0.092 |
| B. 1.0% Reaction product of 1 mole of oleic acid & 5 moles ethylene oxide 14 — | | 6.3 | 0.097 | 0.013 | |
| C. 0.85% of (A) + 0.15% (B) 62 | | 6.5 | 7.3 | 0.090* | 0.090 |
| D. 1.0% of reaction product A and oleyl amine 39 | | — | 7.2 | 0.075 | 0.079 |
| E. 0.75% of D and 0.25% B 30 | | — | 7.2 | 0.084* | 0.098 |
| F. 1.0% of D and 1.0% B 56 | | 6.7 | 7.3 | 0.082 | — |

*Very smooth friction

TABLE III

STEEL IRONING TEST RESULTS

| Ratio | Ironing Work Relative To Neat Lard Oil — Wt. % Additives in Distilled Water: 1% | 4% |
|---|---|---|
| A/B | | |
| 85/15 | 0.98 | 0.99 |
| 99/1 | 1.02 | 1.01 |
| | **Die and Punch Pick-up Relative to Neat Lard Oil — Wt. % Additives In Distilled Water: 1%** | **4%** |
| 85/15 | 0.72 | 1.15 |
| 99/1 | 1.21 | 2.53 |

Other conventional additives are operable in the lubricants of this invention. Such additives include water-soluble or water-emulsifiable oxidation inhibitors, antirust agents and the like.

Obviously, many modifications and variations of the invention, as hereinbefore set forth, may be made in this invention without departing from the scope thereof. Therefore only such limitations should be imposed as are indicated in the appended claims.

What is claimed is:

1. A water-based lubricating composition suitable for metal cutting, grinding, and forming operations and as a hydraulic fluid, comprising an emulsion containing from 0.5 to 4.0 percent of a $C_6$ to $C_{18}$ alkylphosphonate or an amine adduct thereof and an ethoxylate of an acid or an alcohol containing from 3 to 20 ethoxy groups, balance water.

2. The composition according to claim 1 containing the reaction product of dimethyltetradecane phosphonate and oleyl amine.

3. The composition according to claim 1 containing an 85/15 mixture of dimethyltetadecane phosphonate and 5-ethoxy-oleyl ester.

* * * * *